US011470906B2

(12) United States Patent
Basson et al.

(10) Patent No.: US 11,470,906 B2
(45) Date of Patent: Oct. 18, 2022

(54) PROTECTIVE HELMET AND FACE SHIELD

(71) Applicant: MSA Production France, Chatillon sur Chalaronne (FR)

(72) Inventors: Gilles Basson, Chatillon sur Chalaronne (FR); Clément Tuffery, Chatillon sur Chalaronne (FR)

(73) Assignee: MSA Production France, Chatillon sur Chalaronne (FR)

( * ) Notice: Subject to any disclaimer, the term of this patent is extended or adjusted under 35 U.S.C. 154(b) by 552 days.

(21) Appl. No.: 15/112,842

(22) PCT Filed: Jan. 21, 2015

(86) PCT No.: PCT/EP2015/051053
§ 371 (c)(1),
(2) Date: Jul. 20, 2016

(87) PCT Pub. No.: WO2015/110442
PCT Pub. Date: Jul. 30, 2015

(65) Prior Publication Data

US 2016/0331059 A1 Nov. 17, 2016

(30) Foreign Application Priority Data

Jan. 21, 2014 (FR) ..... 1450446

(51) Int. Cl.
*A42B 3/22* (2006.01)
*A42B 3/08* (2006.01)

(52) U.S. Cl.
CPC ..... *A42B 3/222* (2013.01); *A42B 3/085* (2013.01); *A42B 3/225* (2013.01)

(58) Field of Classification Search
CPC ..... A42B 3/222; A42B 3/085; A42B 3/225; A42B 3/22
See application file for complete search history.

(56) References Cited

U.S. PATENT DOCUMENTS 2,204,688 A * 6/1940 McClung ..... A42B 3/22 2/10
3,345,642 A * 10/1967 Uminski ..... A42B 3/22 2/410
4,287,615 A * 9/1981 Morin ..... A42B 3/22 2/10

(Continued)

FOREIGN PATENT DOCUMENTS

DE 8534132 U1 6/1986
FR 2987982 A1 9/2013

(Continued)

*Primary Examiner* — Sally Haden
(74) *Attorney, Agent, or Firm* — Jones Day

(57) ABSTRACT

A protective helmet (1), including a shell (2), a cap (3) attached in the shell (2), and a movable face shield (4) attached to the shell (2) by at least one assembly arrangement, which includes: a rod (40) connected to the shell (2) in an articulated manner about a first substantially transverse axis (51) and a second substantially transverse axis (52); and a rail (55) positioned on the shield (4) and having at least one guide surface (59) that operates with at least one element (56, 58*a*, 58*b*) to guide the movement of the face shield (4) between a lowered and raised position and along, but spaced from, the shell (2).

19 Claims, 7 Drawing Sheets

(56) References Cited

U.S. PATENT DOCUMENTS

| | | | | |
|---|---|---|---|---|
| 4,918,752 | A * | 4/1990 | Briggs | A42B 3/042 2/424 |
| 6,892,393 | B1 * | 5/2005 | Provost | A42B 3/185 2/10 |
| 2002/0148032 | A1 * | 10/2002 | Basson | A42B 3/042 2/422 |
| 2010/0064405 | A1 * | 3/2010 | McGovern | A42B 3/225 2/6.7 |
| 2010/0229288 | A1 * | 9/2010 | Higgins | A42B 3/185 2/422 |
| 2011/0072548 | A1 * | 3/2011 | Hersick | A42B 3/12 2/5 |
| 2013/0219599 | A1 * | 8/2013 | Garcia | A42B 3/226 2/424 |
| 2014/0033406 | A1 * | 2/2014 | Lebel | A42B 3/04 2/422 |
| 2015/0040299 | A1 | 2/2015 | Guay et al. | |
| 2016/0000167 | A1 * | 1/2016 | Alley | A42B 3/22 2/412 |

FOREIGN PATENT DOCUMENTS

| | | |
|---|---|---|
| JP | S5615741 U | 2/1981 |
| WO | 9719606 A1 | 6/1997 |

* cited by examiner

Fig. 3
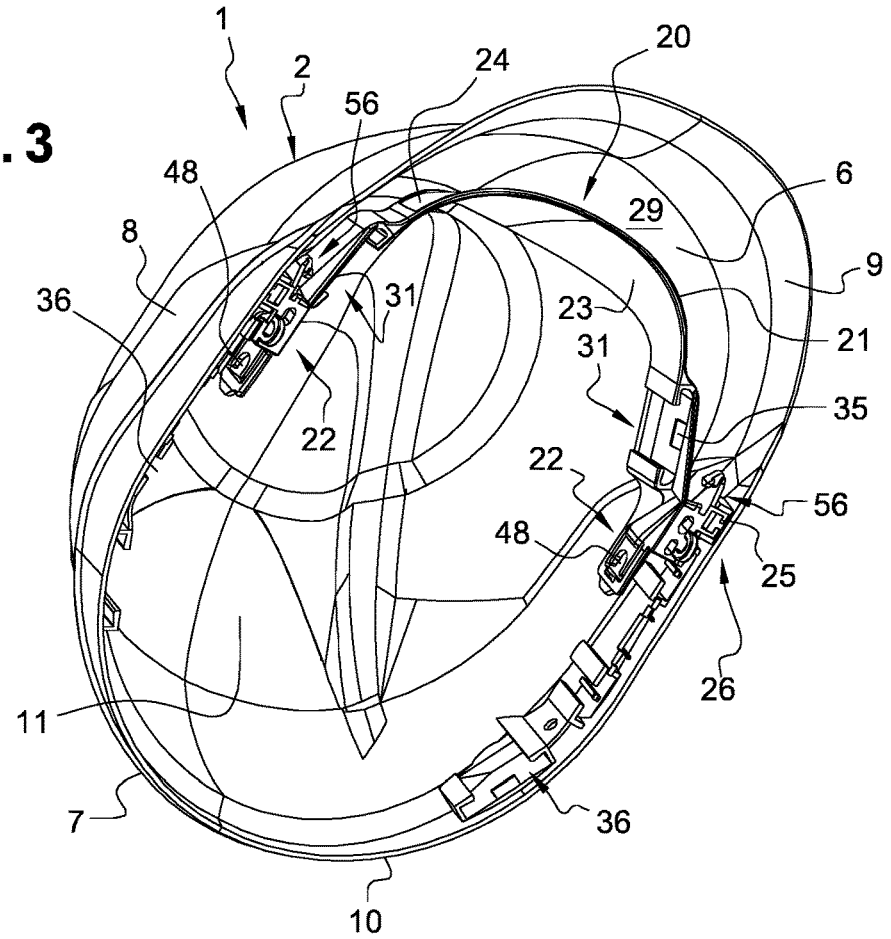
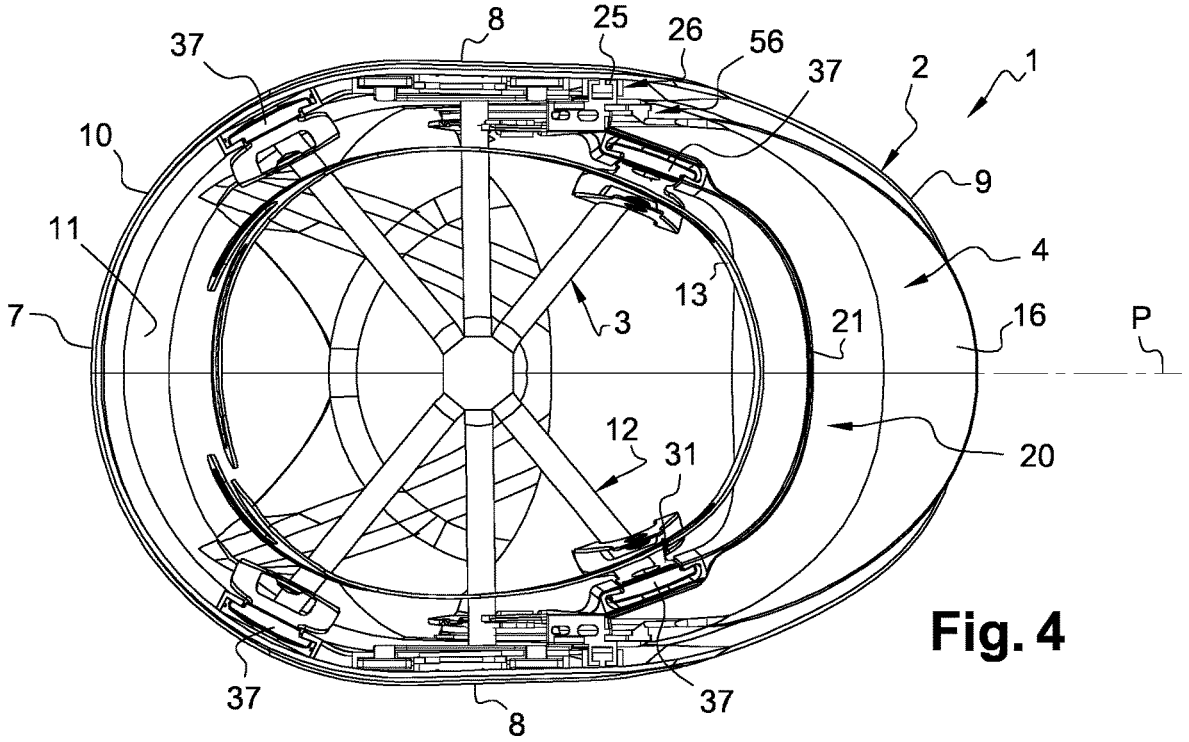
Fig. 4

Fig. 8
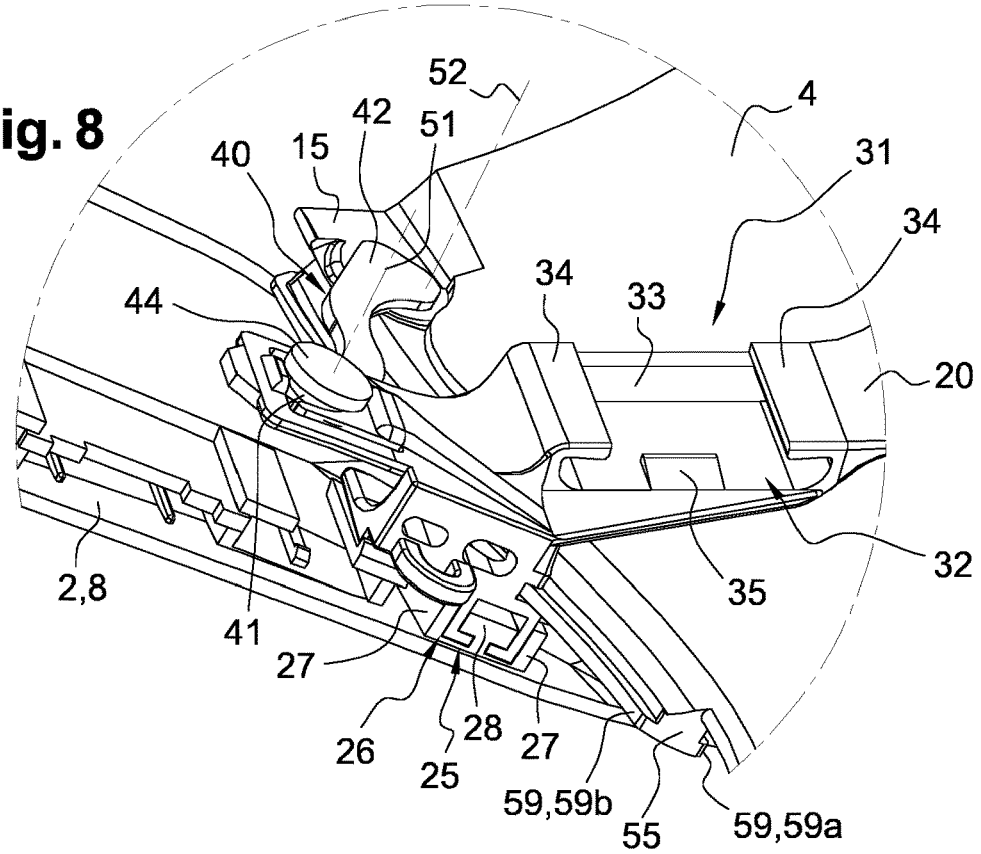
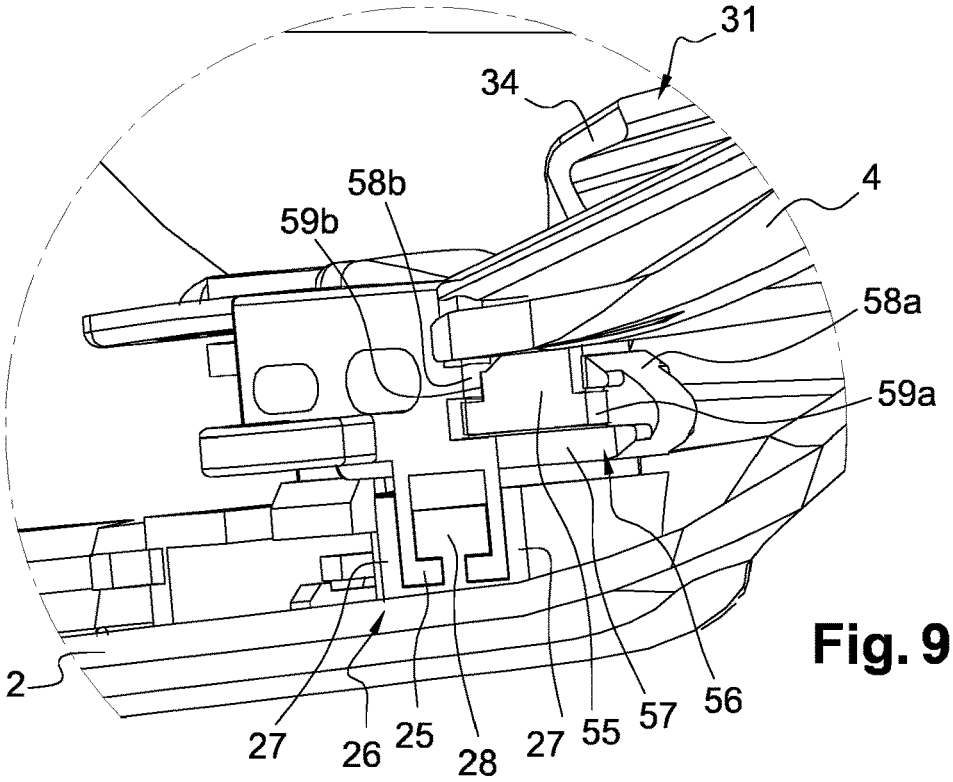
Fig. 9

PROTECTIVE HELMET AND FACE SHIELD

CROSS-REFERENCE TO RELATED APPLICATIONS

This application is the United States national phase of International Application No. PCT/EP2015/051053 filed Jan. 21, 2015, and claims priority to French Patent Application No. 1450446 filed Jan. 21, 2014, the disclosures of which are hereby incorporated in their entirety by reference.

BACKGROUND OF THE INVENTION

Field of the Invention

The present invention concerns a protective helmet equipped with a movable face shield.

Description of Related Art

Some people show up at work wearing a helmet to protect themselves, for example at industrial or construction sites. Such a helmet typically includes a shell for protecting the head and a cap that is mounted on the interior of the shell and which includes, on the one hand, a suspension mounting intended to rest on the user's head and, on the other hand, a headband.

Furthermore, this type of helmet can include a face shield for protecting the user's face. The shield is, relative to the shell, mounted movably between a lowered position, in which is located roughly in front of the user's face, and a raised position. Thus, the user can place the shield in the raised position when circumstances do not require protecting the face or when he/she wants to take the helmet off. Conversely, the shield can be lowered when the face has to be protected.

On some helmets, the shield is constructed so as to be located on the exterior of the shell when it is in the raised position. The risk of the shield being damaged is then increased, since the shield is exposed. On other helmets, the shield is constructed such that, in the raised position, it is located on the interior of the shell. This arrangement is advantageous in terms of protecting the shield. However, it complicates the design of the system for assembling the shield onto the shell when the space available is relatively limited and when the movement of the shield must not interfere with either the user's head or the other helmet components, particularly the cap. Installing the shield can likewise turn out to be less easy and/or to be tedious. Generally, it proves to be necessary to provide a new shell with larger dimensions in order to be able to house the shield in the raised position inside the shell.

Accordingly, it is desirable to provide a protective helmet and face shield that addresses the various issues discussed above.

SUMMARY OF THE INVENTION

Generally, provided are an improved protective helmet and face shield for use in environments that require such user protection. Preferably, provided are an improved protective helmet and face shield where the face shield is movable or retractable between a protective position and a retracted position. Preferably, provided are an improved protective helmet and face shield that facilitate retraction of the face shield into the interior of the shell of the helmet.

For this purpose, and in one preferred and non-limiting embodiment or aspect, the invention concerns a helmet including: a shell intended to protect the head of a user; a cap mounted on the interior of the shell and including a suspension mounting, intended to rest on the head of the user, and a headband; a face shield including a central portion and two side wings, each assembled onto the shell by means of an assembly device, the shield being mounted on the interior of the shell in a manner movable between: a lowered position, in which the shield is located roughly in front of the user's face; and a raised position, in which the shield is located in the space between the cap and the inside of the shell.

In one preferred and non-limiting embodiment or aspect, each assembly device includes: a rod possessing a first extremity mounted in an articulated manner around a first, roughly transverse axis integral with the shell and a second, extremity mounted in an articulated manner around a second roughly transverse axis integral with an extreme upper part of the side wing of the shield; a rail installed on the side wing of the shield and exhibiting at least one guide surface capable of operating together with an integral element of the shell in order to guide the movement of the shield between its lowered and raised positions, along but at a distance from the inside of the shell.

The rod, therefore, allows the top part of the shield to be guided, which is driven in a circular motion relative to the shell and centered on the first axis of articulation. This allows, in particular, the upper part of the shield to be kept from rubbing against the inside of the shell when the shield, guided by the integral element of the shell and the rail, is moved toward its raised position.

The rail also provides guidance for the shield. For this purpose, the rail is fitted to the geometry of the inside of the shell, in order for the shield to be moved, preferably, close to the inside of the shell but without contact with it, thus without rubbing, which would be detrimental to the fluidity of the shield movement and would damage the shield. Thus, it is possible to house the raised shield in a limited space, in front of the cap and on the interior of the shell while retaining the shell. This is doubly advantageous since, on the one hand, it is not necessary to design a new shell, and on the other hand, the helmet exhibits an unchanged volume.

Thus, in the helmet according to a preferred and non-limiting embodiment or aspect, the rod and the rail together provide optimized guidance for the shield. Moreover, the assembly device according to a preferred and non-limiting embodiment or aspect has a relatively simple structure, requiring only a few pieces and exhibiting a small volume. It is therefore easy to implement.

It may be noted that the components "mounted on the shell" can be mounted on the shell itself or on an intermediate piece that is itself mounted on the shell. As for the components "integral with the shell", that is, having a fixed position with respect to the shell, they can be fastened onto the shell itself or onto an intermediate piece that is itself fastened onto the shell. Similarly, the rail can be a part of the shield, that is, executed as a piece one with the shield, or made of a distinct piece added onto the shield. This rail can, for example, accommodate a leg integral with the shell, or one or several rolling element(s) such as a roller or a caster.

According to a preferred and non-limiting embodiment or aspect, the guide surface includes a lower portion exhibiting a shape similar to the shape of the portion in front of the shell, such that during a first phase of its movement from its raised position to its lowered position, the shield roughly follows the inside of the shell.

By "similar", it is understood that the lower portion of the guide surface and the portion in front of the shell exhibit roughly identical geometries, from the point of view of both the overall shape and the curvature. Thus, if the shape in front of the shell is convex, the lower portion of the guide surface is also convex. Conversely, if the shape in front of the shell dips toward the front in a nearly straight manner, the lower portion of the guide surface can be roughly planar, or curved a little, and dipping forward.

According to this preferred and non-limiting embodiment or aspect, the lower portion of the guide surface, which guides the first phase of movement in lowering the shield, is therefore designed so that the path of the shield, during this first phase, is roughly parallel to the lower side of the shell, preferably following close to the shell, that is, leaving little space between the shield and the shell. Consequently, on the one hand, it is not necessary to increase the dimensions of the shell in order to allow the shield to leave the place where it is stored in the raised position and to exit the shell. On the other hand, another advantage of providing such a path during the first phase is that the shield passes relatively far from the face of the user and in particular cannot strike the nose or glasses of the user.

For example, the lower portion of the guide surface can be provided as convex toward the front. This is generally adapted for a shell exhibiting a front portion rounded roughly as part of a sphere, and/or whose lower front edge is relatively low relative to the top of the shell. Generally, the lower portion of the guide surface can have a non-constant radius of curvature. However, other variant embodiments are possible.

Thus, the trajectory of the shield during this first phase of downward movement, a trajectory that is imposed by the rail, cannot correspond to the shape of the front portion of the shell. A roughly straight trajectory slanting toward the bottom and forward can be envisioned, for example, even for a helmet having a front portion convex, particularly if the volume constraints are less severe and the shell can be more capacious.

In addition, the guide surface can include a portion that is situated above the lower portion and which exhibits a roughly rectilinear shape or has a very slight radius of curvature designed to cause, during a second phase of the movement of the shield from its raised position to its lowered position, a roughly vertical and downward movement of the shield. During the second phase, the shield has come out of the reduced space in which it is housed sufficiently to be able to be driven by a different motion that does not risk making it rub against the inside of the shell.

The term "above" is understood to be when the helmet is carried by a user who is standing, with the shield in the lowered position. In practice, this portion of the rail can be an upper portion, or a central portion if an upper portion with a different shape is provided.

According to a preferred and non-limiting embodiment or aspect, the guide surface includes in addition an upper portion that is curved, with the concavity directed forward, or that is roughly rectilinear, being inclined from the rear forward from bottom to top, such that, during a third phase of its movement from its raised position to its lowered position, the shield comes close to the user's face. This upper portion corresponds to the last part of the downward movement of the shield. Once the shield has left the shell almost completely while remaining relatively far from the face in order to allow the first movement phases (as previously explained), the aforementioned configuration allows movement close to the face to be imposed on the shield. Due to this, the shield can provide effective protection of the user's face, particularly against elements that could be thrown up from below to the face and that could not pass through the reduced space existing between the face and the shield. However, it could be envisaged, particularly for those who wear glasses, that the shield could be placed in an intermediate position, not completely lowered, in which the shield would even then be in front of the face, but in a position less close to the face than if it were lowered completely. In one preferred and non-limiting embodiment or aspect, the guide surface has, for example, the shape of a very flat "S".

As a variant, particularly for shells whose front portion dips forward in almost a straight manner and/or whose lower front edge is moved only a little downward relative to the top of the shell, the guide surface can be devoid of a central part between the abovementioned lower and upper portions. Thus the shield can first of all be moved forward and downward in order to exit the shell, along a path that can be more or less curved or even roughly rectilinear. The shield can come close to the face by rotating, without a roughly vertical intermediate phase.

According to one possible embodiment, the rail exhibits, in cross-section, an "L" or a "T" shape, and it is housed in a sliding track integral with the shell, exhibiting, in cross-section, a "U" or a "C" shape. The element integral with the shell, capable of operating together with the guide surface, can be made by one, at least, of the extremities of the "U" or the "C", forming a leg. The guidance is obtained by friction. As a variant, the element integral with the shell, capable of operating together with the guide surface, could be a rolling element of the roller or caster type, providing guidance, this element not necessarily being associated with a sliding track in a "U" or a "C".

The rail can project laterally toward the exterior of the corresponding side wing. According to other possible variants, the rail can be made projecting laterally toward the interior of the corresponding side wing; the rail can be made projecting rearward from the corresponding side wing, roughly extending the side wing. According to a preferred and non-limiting embodiment or aspect, the helmet includes at least one distinct support for the shell, mounted on the inside of the shell, and which includes at least one housing for receiving a body for hanging the cap onto the shell, said housing being situated in the vicinity of one of the user's temples when the user is wearing the helmet. In other words, the housing is situated laterally on the helmet, and rather forward. With this embodiment, it is possible to free up a space in the shape of a crescent, located in the front of the cap and, in part, lateral to it, in order to house the raised shield.

In a preferred and non-limiting embodiment or aspect, the support can include: a device for linking to the first extremity of the rod, allowing the articulation of the rod about the first axis; the element capable of operating together with the rail's guide surface, said element installed on the side wing of the shield, for example in the shape of a leg.

This configuration includes a great number of advantages: with regard to a configuration variant in which the rod and/or the element are not linked to the support but to another intermediate piece, itself fastened onto the shell, this configuration allows the whole to be integrated onto one and the same piece; with regard to a configuration variant in which the rod and/or the element are linked directly to the shell, this configuration: (i) avoids having to execute extra holes in the shell, which would be detrimental to the quality of protection for the head of the user, (ii) allows the space in front to be freed up, therefore not forcing the shell to be enlarged, and (iii) allows the existing shell to be retained.

For example, the support can exhibit a roughly semi-circular shape, be fastened to the inside of the shell roughly in the vicinity of each of its lateral extremities, and be disposed horizontally on the whole between the headband and the inside of the shell, a space being located between the support and the inside of the shell to receive the shield in the raised position. As a variant, it could be envisaged to provide only two lateral supports with reduced dimensions, which are not extended and do not meet in front, in the interior of the shell.

According to a preferred and non-limiting embodiment or aspect, the shield includes two orifices, each made in the upper part of a side wing, the two orifices having roughly the same transverse axis, which corresponds to the second axis of articulation for the rod.

Advantageously, the shield can be designed to extend roughly up to the temples of the user when the user is wearing the helmet. With this configuration, which allows the user to be efficiently protected, the problem of space necessary to house the shield itself on the interior of the helmet, on the one hand, and on the other hand to house each of the two side assembly devices of the shield to the shell, is much more complex.

In one preferred and non-limiting embodiment or aspect, provided is a protective helmet, including: a shell configured to protect the head of a user; a cap attached in the interior of the shell; and a face shield attached to the shell by at least one assembly arrangement, wherein the face shield is movable between: a lowered position in which the face shield is located substantially in front of the user's face; and a raised position in which the face shield is located in a space between the cap and the inside of the shell; wherein the at least one assembly arrangement includes: a rod having a first end connected to a portion of the shell in an articulated manner about a first substantially transverse axis and a second end connected to a portion of the shield in an articulated manner about a second substantially transverse axis; and a rail positioned on the shield and having at least one guide surface configured to operate together with at least one element to guide the movement of the face shield between the lowered and raised positions and along, but spaced from, the shell.

In one preferred and non-limiting embodiment or aspect, the helmet includes two assembly arrangements, wherein the second end of each rod is connected to an upper portion of a respective side wing of the face shield.

In one preferred and non-limiting embodiment or aspect, the at least one guide surface includes a lower portion having a shape substantially similar to the shape of a front portion of the shell, such that, during a first phase of the movement from the raised position to the lowered position, the movement of the shield substantially follows at least a portion of the inside of the shell. In one preferred and non-limiting embodiment or aspect, the lower portion of the at least one guide surface is substantially convex toward the front.

In one preferred and non-limiting embodiment or aspect, the at least one guide surface includes a portion located above the lower portion and having a substantially rectilinear shape configured to cause, during a second phase of movement of the shield from the raised position to the lowered position, a substantially vertical and downward movement of the shield.

In one preferred and non-limiting embodiment or aspect, the at least one guide surface includes a portion located above the lower portion and having a radius of curvature configured to cause, during a second phase of movement of the shield from the raised position to the lowered position, a substantially vertical and downward movement of the shield.

In one preferred and non-limiting embodiment or aspect, the at least one guide surface includes a curved upper portion having a forward-facing concavity configured to cause, during a third phase of movement from its raised position to its lowered position, the shield to move closer to the user's face.

In one preferred and non-limiting embodiment or aspect, the at least one guide surface includes a substantially rectilinear upper portion, inclined from the rear forward and from bottom to top, configured to cause, during a third phase of movement from its raised position to its lowered position, the shield to move closer to the user's face.

In one preferred and non-limiting embodiment or aspect, the at least one guide surface has a substantially flattened S-shape.

In one preferred and non-limiting embodiment or aspect, the cross section of the rail is substantially L-shaped or substantially T-shaped, and the rail is housed in a sliding track having a cross section that is substantially U-shaped or substantially C-shaped.

In one preferred and non-limiting embodiment or aspect, the rail projects laterally and toward the outside of a side wing of the face shield.

In one preferred and non-limiting embodiment or aspect, the helmet further includes at least one support mounted in the interior of the shell and including at least one housing configured to receive a body configured to connect the cap to the shell. In another preferred and non-limiting embodiment or aspect, the at least one housing is positioned substantially near a user's temple when the user is wearing the helmet. In another preferred and non-limiting embodiment or aspect, the at least one support includes an arrangement configured to link to the first end of the rod, thereby facilitating articulation of the rod around the first axis, wherein the at least one element is configured to operate together with the at least one guide surface of the rail. In a further preferred and non-limiting embodiment or aspect, the at least one element is positioned on a side wing of the shield. In another preferred and non-limiting embodiment or aspect, the at least one support has a substantially semicircular shape and is fastened to the inside of the shell, wherein the at least one support is substantially horizontally disposed between a headband and the inside of the shell, and wherein a space is located between the support and the inside of the shell and sized to receive the shield in the raised position.

In one preferred and non-limiting embodiment or aspect, the shield includes at least one orifice having substantially the same transverse axis corresponding to the second axis of articulation of the rod.

In one preferred and non-limiting embodiment or aspect, the shield is configured to extend substantially as far as the user's temples when the user is wearing the helmet.

In one preferred and non-limiting embodiment or aspect, the shield includes a lower rim projecting toward the front.

In one preferred and non-limiting embodiment or aspect, provided is an assembly arrangement for connecting a face shield of a protective helmet to a shell of the protective helmet, the face shield is movable between: a lowered position in which the face shield is located substantially in front of the user's face; and a raised position in which the face shield is located in a space in the inside of the shell, the assembly arrangement including: a rod having a first end connected to a portion of the shell in an articulated manner about a first substantially transverse axis and a second end connected to a portion of the shield in an articulated manner about a second substantially transverse axis; and a rail positioned on the shield and having at least one guide surface configured to operate together with at least one element to guide the movement of the shield between the lowered and raised positions and along, but spaced from, the shell.

Preferred and non-limiting embodiments or aspects of the present invention will now be described in the following numbered clauses:

Clause 1. A protective helmet, comprising: a shell configured to protect the head of a user; a cap attached in the interior of the shell; and a face shield attached to the shell by at least one assembly arrangement, wherein the face shield is movable between: a lowered position in which the face shield is located substantially in front of the user's face; and a raised position in which the face shield is located in a space between the cap and the inside of the shell; wherein the at least one assembly arrangement comprises: a rod having a first end connected to a portion of the shell in an articulated manner about a first substantially transverse axis and a second end connected to a portion of the shield in an articulated manner about a second substantially transverse axis; and a rail positioned on the shield and having at least one guide surface configured to operate together with at least one element to guide the movement of the face shield between the lowered and raised positions and along, but spaced from, the shell.

Clause 2: The helmet of clause 1, further comprising two assembly arrangements, wherein the second end of each rod is connected to an upper portion of a respective side wing of the face shield.

Clause 3: The helmet of clauses 1 or 2, wherein the at least one guide surface comprises a lower portion having a shape substantially similar to the shape of a front portion of the shell, such that, during a first phase of the movement from the raised position to the lowered position, the movement of the shield substantially follows at least a portion of the inside of the shell.

Clause 4: The helmet of clause 3, wherein the lower portion of the at least one guide surface is substantially convex toward the front.

Clause 5: The helmet of any of clauses 1-4, wherein the at least one guide surface comprises a portion located above the lower portion and having a substantially rectilinear shape configured to cause, during a second phase of movement of the shield from the raised position to the lowered position, a substantially vertical and downward movement of the shield.

Clause 6: The helmet of any of clauses 1-5, wherein the at least one guide surface comprises a portion located above the lower portion and having a radius of curvature configured to cause, during a second phase of movement of the shield from the raised position to the lowered position, a substantially vertical and downward movement of the shield.

Clause 7: The helmet of any of clauses 1-6, wherein the at least one guide surface includes a curved upper portion having a forward-facing concavity configured to cause, during a third phase of movement from its raised position to its lowered position, the shield to move closer to the user's face.

Clause 8: The helmet of any of clauses 1-7, wherein the at least one guide surface includes a substantially rectilinear upper portion, inclined from the rear forward and from bottom to top, configured to cause, during a third phase of movement from its raised position to its lowered position, the shield to move closer to the user's face.

Clause 9: The helmet of clause any of clauses 1-8, wherein the at least one guide surface has a substantially flattened S-shape.

Clause 10: The helmet of any of clauses 1-9, wherein the cross section of the rail is substantially L-shaped or substantially T-shaped, and the rail is housed in a sliding track having a cross section that is substantially U-shaped or substantially C-shaped.

Clause 11: The helmet of any of clauses 1-10, wherein the rail projects laterally and toward the outside of a side wing of the face shield.

Clause 12: The helmet of any of clauses 1-11, further comprising at least one support mounted in the interior of the shell and comprising at least one housing configured to receive a body configured to connect the cap to the shell.

Clause 13: The helmet of clause 12, wherein the at least one housing is positioned substantially near a user's temple when the user is wearing the helmet.

Clause 14: The helmet of any of clauses 12 or 13, wherein the at least one support comprises an arrangement configured to link to the first end of the rod, thereby facilitating articulation of the rod around the first axis, wherein the at least one element is configured to operate together with the at least one guide surface of the rail.

Clause 15: The helmet of any of clauses 12-14, wherein the at least one element is positioned on a side wing of the shield.

Clause 16: The helmet of any of clauses 12-15, wherein the at least one support has a substantially semi-circular shape and is fastened to the inside of the shell, wherein the at least one support is substantially horizontally disposed between a headband and the inside of the shell, and wherein a space is located between the support and the inside of the shell and sized to receive the shield in the raised position.

Clause 17: The helmet of any of clauses 1-16, wherein the shield comprises at least one orifice having substantially the same transverse axis corresponding to the second axis of articulation of the rod.

Clause 18: The helmet of any of clauses 1-17, wherein the shield is configured to extend substantially as far as the user's temples when the user is wearing the helmet.

Clause 19: The helmet of any of clauses 1-18, wherein the shield comprises a lower rim projecting toward the front.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

BRIEF DESCRIPTION OF THE DRAWINGS

FIG. 3 is a perspective view of the interior of the helmet of FIG. 1, showing the support mounted on a shell;

FIG. 4 is a view of the helmet of FIG. 1 from below, with the components in the mounted position;

FIG. 8 is a detailed perspective view of the helmet of FIG. 1, showing the installation of a rod between the support and the shield;

FIG. 9 is a detailed perspective view of the helmet of FIG. 1, showing the assembly of the support on the shell, and the combined operation of the rail of the shield and an element integral with the shell;

FIGS. 11-14*a* are longitudinal sectional views of the helmet of FIG. 1 showing successive phases of movement for the shield from its raised position to its lowered position;

DETAILED DESCRIPTION

Figure 1:
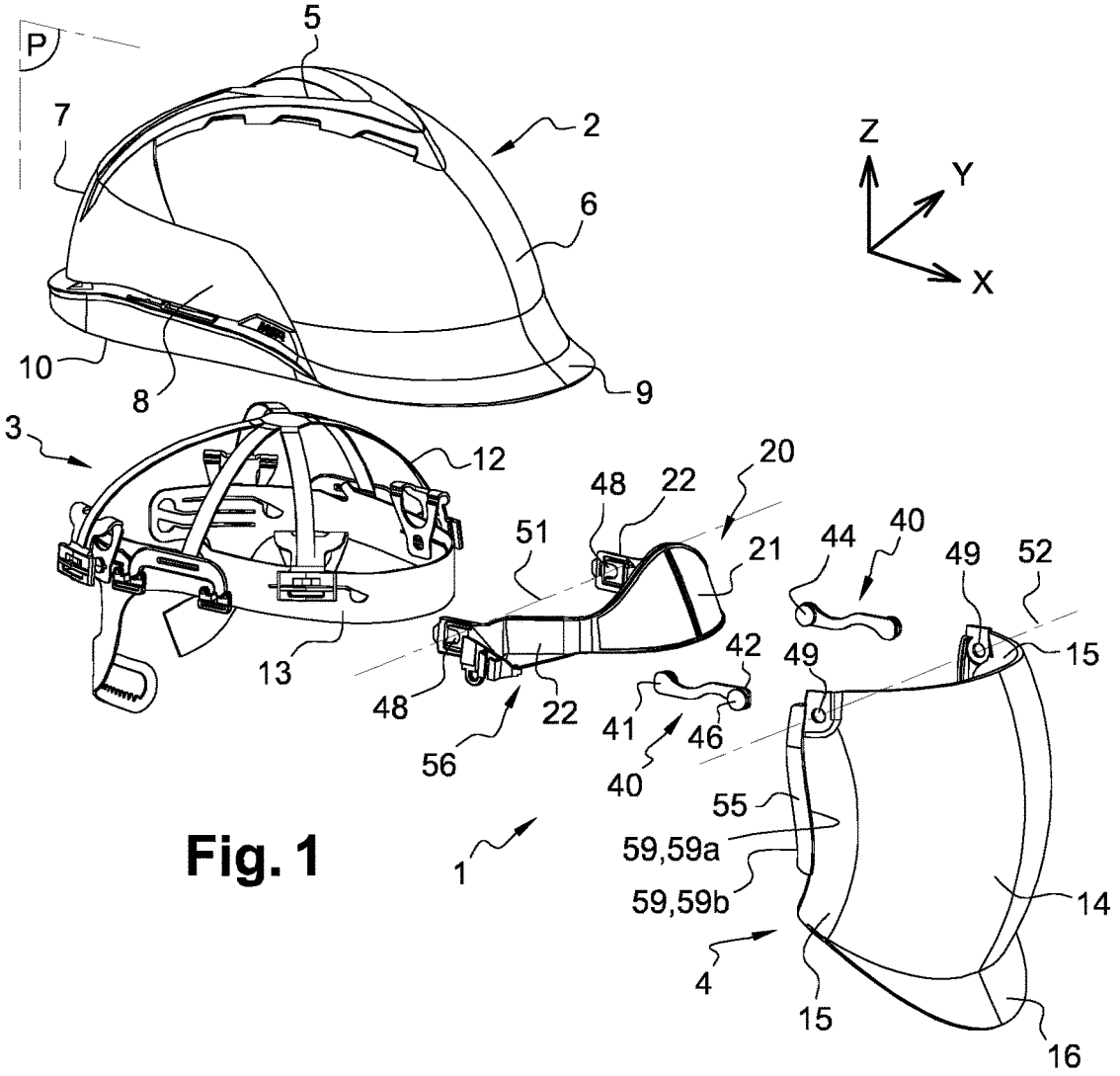
FIG. 1 is a side and exploded side view of a helmet according to the principles of the present invention.

For purposes of the description hereinafter, and unless otherwise defined, the terms "end", "upper", "lower", "right", "left", "vertical", "horizontal", "top", "bottom", "lateral", "longitudinal" and derivatives thereof shall relate to the invention as it is oriented in the drawing figures. It is to be understood that the invention may assume various alternative variations, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

The present invention relates to a protective helmet and face shield, as illustrated in certain preferred and non-limiting embodiments and configurations in FIGS. 1-15.

As illustrated in one preferred and non-limiting embodiment or aspect in FIG. 1, a helmet 1 includes a shell 2, a cap 3, and a face shield 4. The shell 2 is configured or intended to protect the head of a user. It is generally rigid and is, for example, manufactured from a composite or thermoplastic material. The shell 2 exhibits a longitudinal plane of symmetry (P). In this embodiment, the helmet 1 is described in the position of use, that is, in the position it occupies when it is placed on the head of the user, also called the wearer, who is standing up straight. The transverse direction (Y) is defined as the direction orthogonal to the plane (P), this direction thus being substantially or roughly horizontal. The longitudinal direction (X) is defined as the direction orthogonal to (Y) and substantially or roughly horizontal, and the direction (Z) is the vertical direction.

The terms "inside" or "interior" are used to designate an element closer to the wearer's head, in opposition to the term "outside" or "exterior". The terms "upper", "lower", "top", and "bottom" are used in reference to the Z-direction. The terms "front" and "rear" are used in reference to the X-direction. The terms "side" or "lateral" and "transverse" are used in reference to the Y-direction.

In a preferred and non-limiting embodiment or aspect, the shell 2 has the general shape of a dome. It includes an upper portion 5, a front portion 6 extending from the upper portion 5 substantially or roughly at the forehead of the user, a rear portion 7, and two side portions 8. The shell 2 can also include a front rim 9 forming a visor. In the embodiment depicted, the side portions 8 are substantially or roughly flat, at least in their central zone. In addition, the lower edge of the shell 2 can be substantially or roughly contained within a plane, for example a plane parallel to (X, Y). The shell 2 exhibits an inside 11.

In a preferred and non-limiting embodiment or aspect, the cap 3, which is mounted in the interior of the shell 2, is intended or configured for adjustment and for holding the helmet 1 on the head of the wearer, with concern for comfort and efficiency of protection. The cap 3 includes a suspension mounting 12 designed or configured to rest on the user's head, and which can include several bands linked to one another in their central zone, below the upper portion 5 of the shell 2. In the embodiment depicted, the suspension mounting 12 includes six bands, one band of which is constructed substantially or roughly in a plane (Y,Z).

In a preferred and non-limiting embodiment or aspect, the cap 3 also includes a headband 13, preferably of a size that can be adjusted to the head of the user. The headband 13 can be assembled onto the suspension mounting 12, for example, at the lower ends of the bands of the suspension mounting 12. The cap 3 can also include a chinstrap (not depicted), assembled, for example, onto the headband 13.

Figure 10:
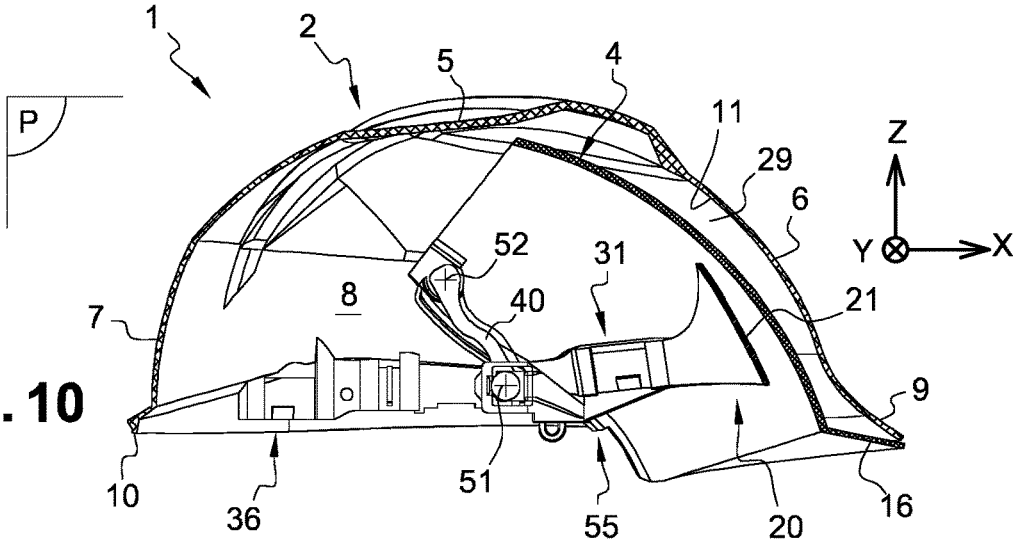
FIG. 10 is a longitudinal sectional view of the helmet of FIG. 1 with the shield in the raised position.
Figure 15:
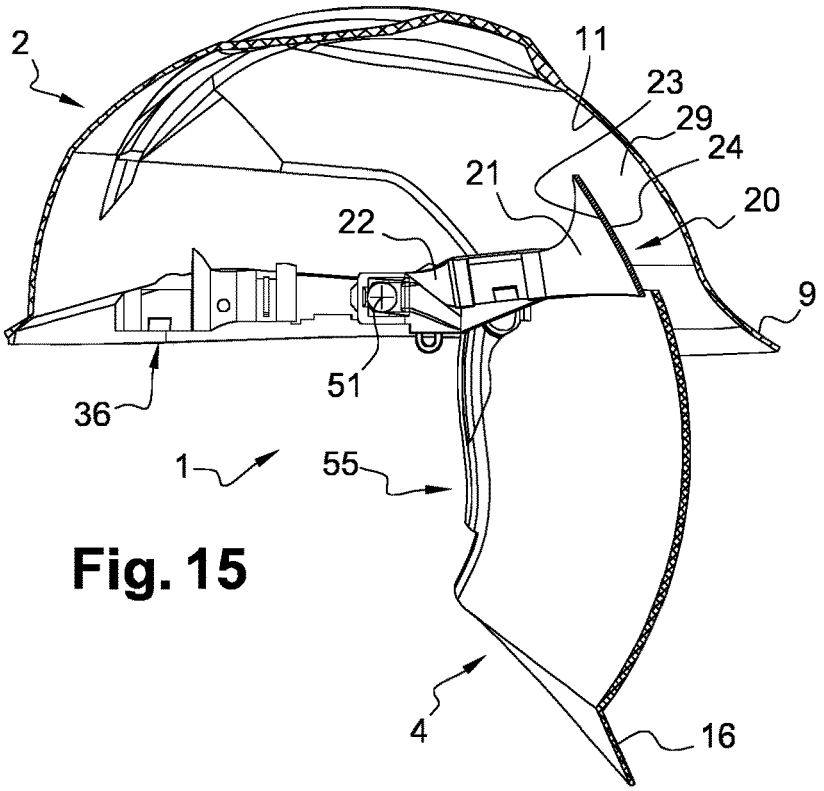
FIG. 15 is a longitudinal sectional view of the helmet of FIG. 1 with the shield in the lowered position.

In a preferred and non-limiting embodiment or aspect, the face shield 4 includes a central portion 14 and two side wings 15. The side wings 15 can form a piece one with the central portion 14 or can be distinct pieces assembled to the central portion 14. Each side wing 15 is assembled onto the shell 2 by an assembly device. Thus, the shield 4 is mounted on the interior of the shell 2 in a manner that is movable between: a lowered position, in which the shield 4 is located substantially or roughly in front of the user's face, as illustrated in FIG. 15; and a raised position, in which the shield 4 is located in the space between the cap 3 and the inside 11 of the shell 2, as illustrated in FIG. 10.

In a preferred and non-limiting embodiment or aspect, the shield 4 can, moreover, include a lower rim 16 that projects forward. This lower rim 16, which facilitates the manipulation of the shield 4, can form a detent capable of or configured to operating together with the lower front edge of the shell 2, for example with the front rim 9, in order to limit the movement of the shield upward, as seen in FIG. 10. The lower rim 16 in addition allows face covering to be increased and the length of the shield to be reduced that is to be housed inside the shell 2 in its top position.

In a preferred and non-limiting embodiment or aspect, and advantageously, the shield 4, in particular the arrangement and dimensions of the side wings 15, can be designed or configured to extend substantially or roughly to the user's temples when the user is wearing the helmet 1.

Figure 2:
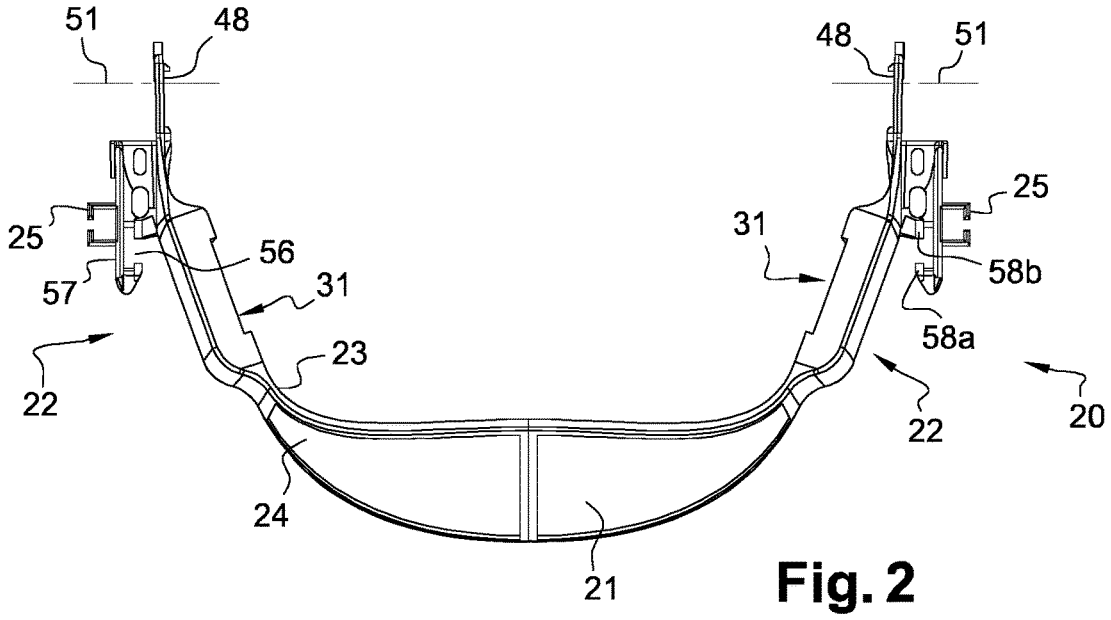
FIG. 2 is a view of a support of the helmet of FIG. 1.

According to one preferred and non-limiting embodiment or aspect, as depicted in the figures, the helmet 1 additionally includes a support 20. However, it can be envisaged that the helmet is not fitted with such a support. In a preferred and non-limiting embodiment or aspect, the support 20, illustrated in particular in FIG. 2, is a piece distinct from the shell 2, generally rigid, and manufactured, for example, in a composite or thermoplastic material. It is fastened to the inside 11 of the shell 2.

In a preferred and non-limiting embodiment or aspect, the support 20 exhibits a substantially or roughly semi-circular shape. It includes a front portion 21 with a rounded shape, for example similar to the shape of front portion 6 of the shell 2 located opposite, and two side arms 22 extending rearward. The support 20 exhibits an inside 23 facing the user's head and an outside 24 facing the inside 11 of the shell 2. In a preferred and non-limiting embodiment or aspect, on the outside 24 of each side arm 22, for example in the vicinity of each of the side ends of support 20, the support includes means of assembling to the inside 11 of the shell 2. These means are presented here in the form of a channel 25 that has a C cross-section with a substantially or roughly vertical axis projecting laterally toward the exterior of each side arm 22.

In a preferred and non-limiting embodiment or aspect, and as seen in FIGS. 3 and 8, in particular, each of these channels is designed or configured to operate together with a device 26 for hanging, installed on the shell 2. Each hanging device 26 projects from the inside 11 of the shell 2, toward the interior, in the vicinity of the front part of a side portion 8 and of lower edge 10 of the shell 2. In the embodiment depicted, the hanging device 26 includes two posts 27 that receive the channel 25 between them, as well as a T-shaped protuberance 28 located between the posts 27 and being housed in channel 25. The support 20 can thus be mounted by vertically sliding upward into the shell 2 and can be held in position by friction and/or a by snapping on.

In a preferred and non-limiting embodiment or aspect, and in the mounted position, the support 20 is horizontally disposed, on the whole, between the headband 13 and the inside 11 of the shell 2, particularly as is seen in FIG. 15. Thus a space 29 exists between the support 20 and the inside 11 of the shell 2, which will allow the shield 4 to be received in the raised position, as will be explained hereinafter.

In a preferred and non-limiting embodiment or aspect, and on the inside 23 of each side arm 22, the support 20 includes a housing 31 for receiving a body for hanging the cap 3 onto the shell 2. This housing 31 is located in front of channel 25, installed on the same aide arm 22, and when the user is wearing the helmet, it is located in the vicinity of a user's temple. Thus, as seen in FIGS. 3 and 4, each of these housings is located laterally on the helmet 1, and rather forward.

In a preferred and non-limiting embodiment or aspect, each housing 31 has substantially or roughly the shape of a parallelepiped, and includes a lower opening 32, a closed upper side 33, two inside rims 34 facing one another, and a projection 35 for snapping on. The shell 2 can exhibit, on its inside 11 and in the vicinity of the rear part of its side portions 8, housings 36 exhibiting a shape similar to that of the housings 31.

In a preferred and non-limiting embodiment or aspect, appendages 37 are provided in the lower part of the cap 3, for example at the ends of the bands forming the suspension mounting 12. These appendages 37 are adjusted to the housings 31 and 36. They can thus exhibit a T cross-section, in order to be able to be engaged by vertically sliding upward into the housings 31, 36 from the lower opening 32 as far as the upper side 33, against which they can abut. These appendages 37 are preferably equipped with a body that can operate together with the snapping projection 35 to ensure that the cap 3 is held in the shell 2. In the embodiment depicted, the suspension mounting 12 includes in the lower part four appendages 37 located laterally in front of and behind the wearer's head, the two rear appendages being engaged in the housings 36 of the shell 2 and the two front appendages being engaged in the housings 31 of the support 20.

In a preferred and non-limiting embodiment or aspect, and when fastening the cap 3 in front (not onto the shell 2 but onto the support 20), a space is freed up between the wearer's head and the shell 2 to house the raised shield 4 in the interior of the shell 2. More precisely, the space 29 between support 20 and the inside 11 of the shell 2 has a crescent shape, extending both in front and laterally, outward from the support 20 to house the shield 4, even if the latter has side wings 15 of relatively large size, in order to ensure good side protection for the wearer of helmet 1. In the raised position, the shield 4 is therefore located in the space between the cap 3 and the inside 11 of the shell 2, but, more precisely, in the space 29 between support 20 and the inside 11 of the shell 2.

In a preferred and non-limiting embodiment or aspect, provided is a device for assembling each side wing 15 of the face shield 4 to the shell 2.

Figure 7:
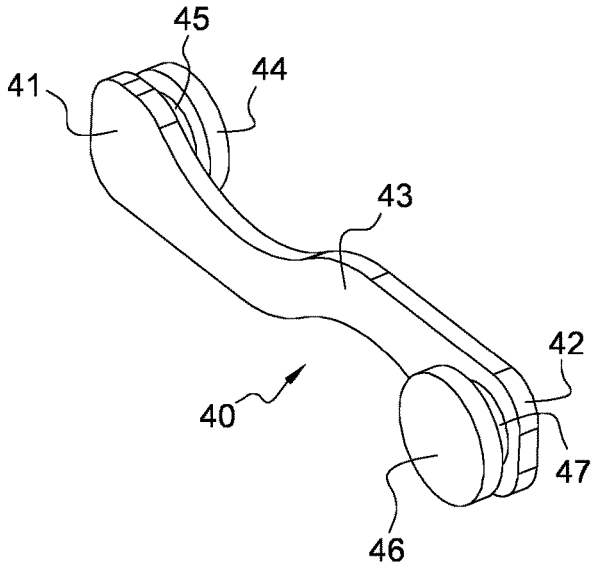
FIG. 7 is a perspective view of a rod of the assembly arrangement or device of the helmet of FIG. 1.

In a preferred and non-limiting embodiment or aspect, the assembly device includes a rod 40 that extends substantially or roughly in a plane (X,Z). The rod 40 has a first end 41 that is mounted articulated about a first axis 51 substantially or roughly transverse and integral with shell 2. It also has a second end 42 that is mounted articulated about a second axis 52 substantially or roughly transverse and integral with an extreme upper part of the side wing 15 of shield 4. The rod 40 can be presented in a practical manner in the form of a rigid, elongated piece, as illustrated in FIG. 7. In this embodiment, the rod 40 includes a principal part 43 in the form of a flat blade. In addition, the rod 40 includes, at its first end 41, a pin 44 provided with a groove 45 and projecting toward the interior, and at its second end 42, a pin 46 provided with a groove 47 and projecting toward the exterior.

In a preferred and non-limiting embodiment or aspect, the pin 44 is designed or configured to be mounted in an orifice 48 of axis 51, installed on a side arm 22 of support 20, at the rear part of this arm. This link between the first end 41 of rod 40 and support 20 allows for the articulation of rod 40 about the first axis 51. The pin 46 is designed or configured to be mounted in an orifice 49 of axis 52, installed in the upper rear part of a side wing 15 of the shield 4. This link between the second end 42 of rod 40 and shield 4 allows for articulation of the rod 40 about the second axis 52.

In a preferred and non-limiting embodiment or aspect, each of the assembly devices includes, in addition, a rail 55, installed on the side wing 15 of shield 4. The rail 55 exhibits at least one guide surface 59 capable of operating together with an element integral with shell 2 to guide the movement of the shield 4 between its lowered and raised positions, along but at a distance from the inside 11 of the shell 2.

In a preferred and non-limiting embodiment or aspect, the rail 55 exhibits a cross-section in the shape of a "T" and is housed in a sliding track 56 integral with shell 2, which exhibits, in cross-section, the shape of a "C". More precisely, as illustrated in FIG. 2, the sliding track 56 can be provided on an external side plate 57 constructed on support 20. In the embodiment depicted, the plate 57 is disposed substantially or roughly in a plane (X,Z) and extends forward from the channel 25 whereof it forms the inside. The sliding track 56 includes two legs 58*a*, 58*b*, in front and in back respectively, forming the extreme parts of the "C".

Figure 5:
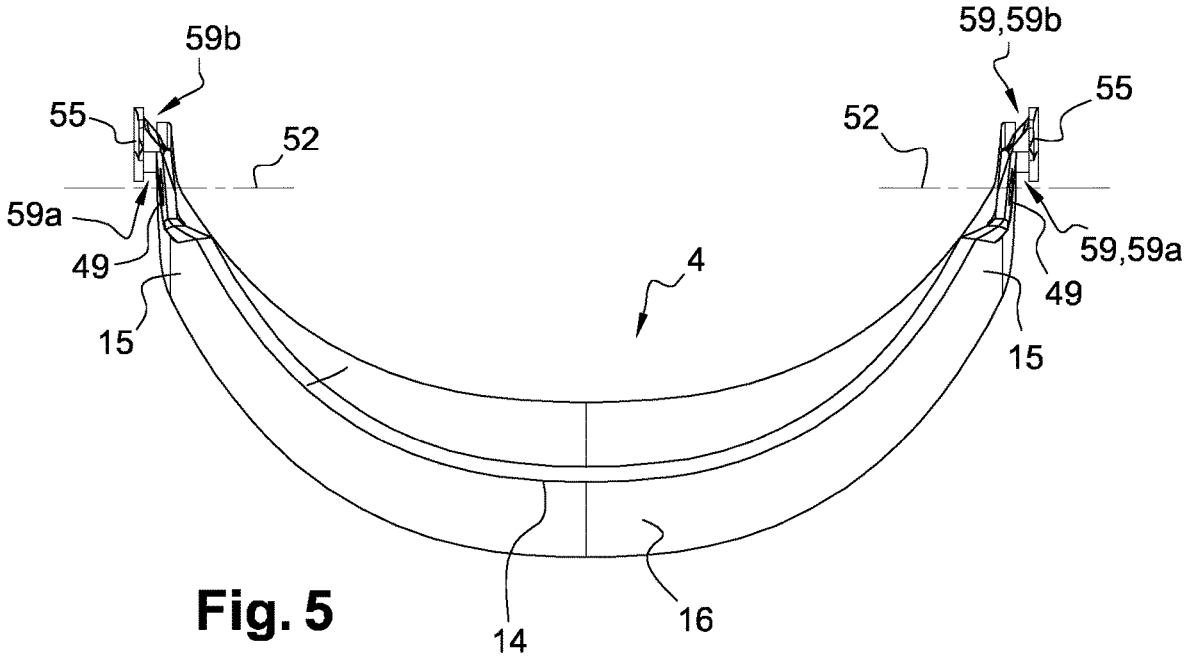
FIG. 5 is a top view of the shield of the helmet of FIG. 1.

In a preferred and non-limiting embodiment or aspect, the rail 55 projects laterally and toward the exterior of the corresponding side wing 15 of shield 4. The sliding track 56 is therefore installed on the interior of the plate 57. However, other embodiments could be envisaged. In a preferred and non-limiting embodiment or aspect, and as is seen in FIGS. 5 and 6, in the case in which the rail 55 exhibits a cross-section in the shape of a "T", it includes two guide surfaces 59*a*, 59*b*, front and rear respectively, which can operate together with the legs 58*a*, 58*b* of support 20 to guide, by sliding with friction, the movement of shield 4.

Figure 6:
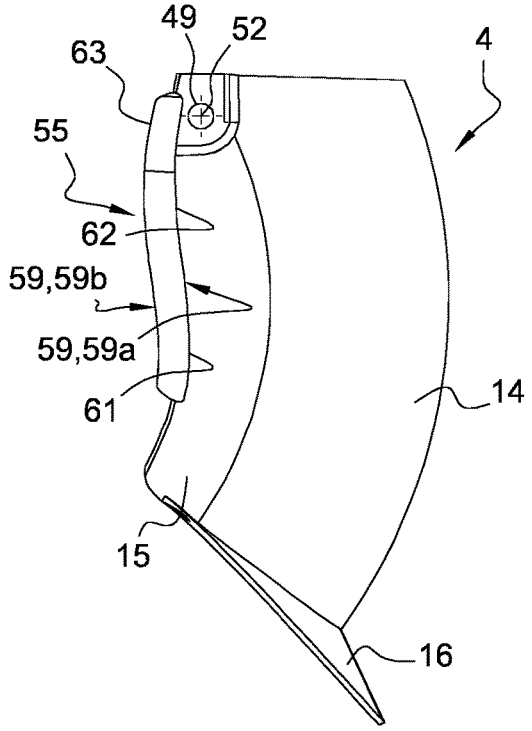
FIG. 6 is a side view of the shield of FIG. 5.

The rail 55 and the guide surface(s) 59 may be described when the shield 4 is in the lowered position, as illustrated in FIGS. 6 and 15. The rail 55 can be situated in a practical manner at the rear and in large part below the orifice 49. In a preferred and non-limiting embodiment or aspect, the guide surface 59 is fitted to the shape of the shell 2 so as to provide appropriate guidance for the shield 4 in its movement between its lowered and raised positions, along but at a distance from the inside 11 of the shell 2, that is, without contact and without friction.

In a preferred and non-limiting embodiment or aspect, the guide surface 59 has the shape of a very flat "S" and includes: a lower portion 61 exhibiting a shape similar to the shape of the front portion 6 of the shell 2, that is, here, convex toward the front; a central portion 62, located above the lower portion 61, which has a substantially or roughly rectilinear shape or has a very slight radius of curvature, substantially or roughly vertical (in the lowered position of the shield 4); and an upper portion 63 that is curved with the concavity facing forward.

Referring to FIGS. 10 to 15, and in a preferred and non-limiting embodiment or aspect, the movement of shield 4 is now described, from its raised position to its lowered position, this movement being guided by means of the constituent elements of the device for assembling shield 4 onto shell 2, that is, in particular, rods 40 and rails 55. The reverse movement of the shield 4, from its lowered position to its raised position, is carried out in a similar manner. In other words, the rod and the rail together provide guidance for the shield substantially over its entire movement from its lowered position to its raised position, and back.

In a preferred and non-limiting embodiment or aspect, and when the shield 4 is in the top position (FIG. 10), it is housed in the space 29 located between support 20 and the inside 11 of shell 2. If and when the cap 3 is mounted on the inside of support 20, the shield 4 is housed outside of the cap 3 and therefore does not come into contact with the wearer's head. In addition, the shield 4 virtually does not project below the lower edge 10 of shell 2, and the lower rim 16 of the shield 4 can butt up against the front rim 9 of shell 2, thus preventing the shield from being raised further. In this position, the first end 41 of the rod 40 is located below and in front of the second end 42. In addition, the sliding track 56 of support 20 operates together with the lower portion 61 of the guide surface 59 of rail 55.

In a preferred and non-limiting embodiment or aspect, and during the movement of shield 4 from its raised position to its lowered position, the first end 41 of rod 40 pivots around the first axis 51, which is fixed relative to the shell 2. In addition, the second end 42 of rod 40, and therefore the extreme upper part of the side wings 15 of shield 4, pivots around the second axis 52, whose position is not fixed relative to shell 2. The rod 40 thus swivels around axis 51, passing through a vertical position (FIG. 11), with the second end 42 then passing in front of the first end 41. At the end of the movement, shield 4 being in the lowered position (FIG. 15), rod 40 is substantially or roughly horizontal. In a preferred and non-limiting embodiment or aspect, shield 4, moreover, in order to pivot around axis 52, is guided by rail 55.

Figure 11:
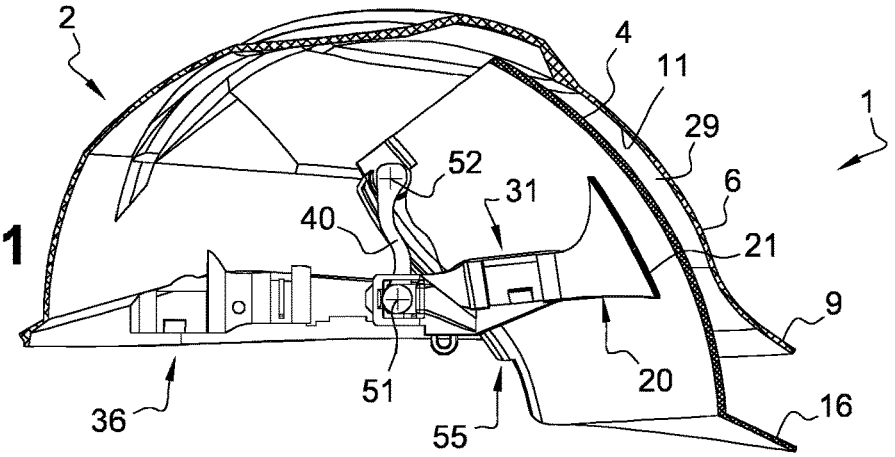
Figure 12:
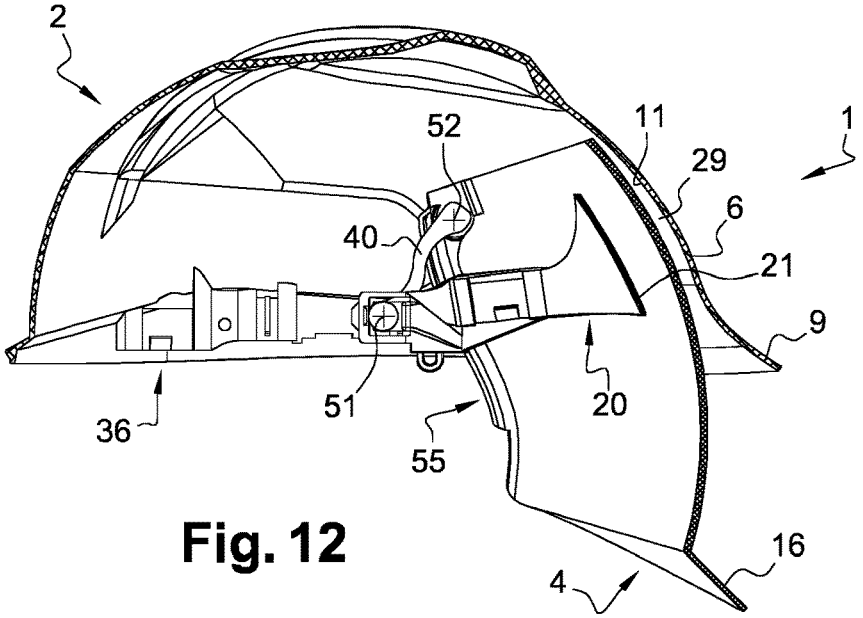
Figure 13:
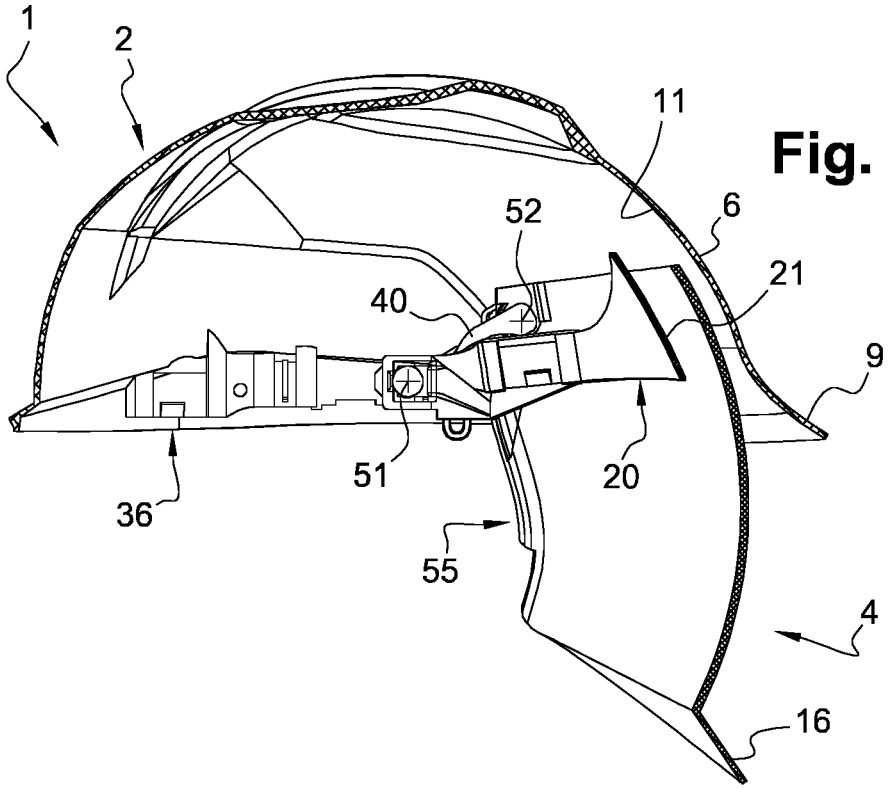

In a preferred and non-limiting embodiment or aspect, and in the course of a first phase of movement of shield 4 from its raised position to its lowered position, the sliding track 56 of support 20 operates together with the lower portion 61 of the guide surface 59 of rail 55, as illustrated in FIGS. 11 to 13. During this first phase, shield 4 pivots around an axis that is movable relative to the shell 2. It is guided to substantially or roughly follow the inside 11 of shell 2, since the lower portion 61 exhibits a shape similar to the shape of the front portion 6 of shell 2. This movement can thus be carried out in a space 29 of limited size.

Figure 14A:
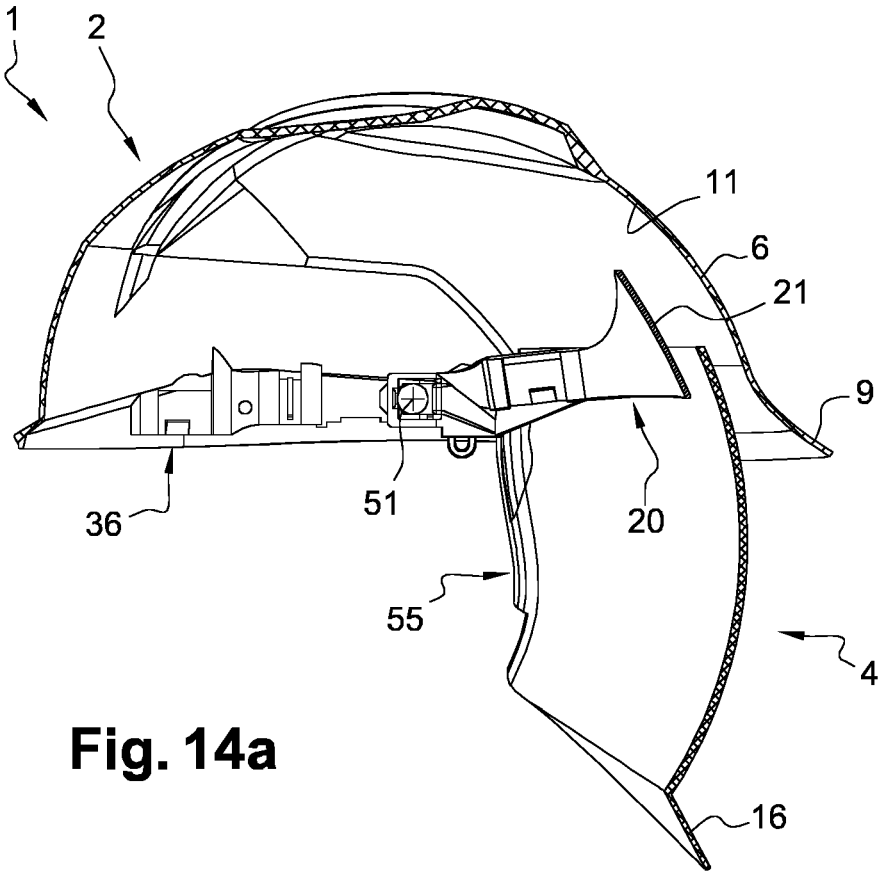
Figure 14B:
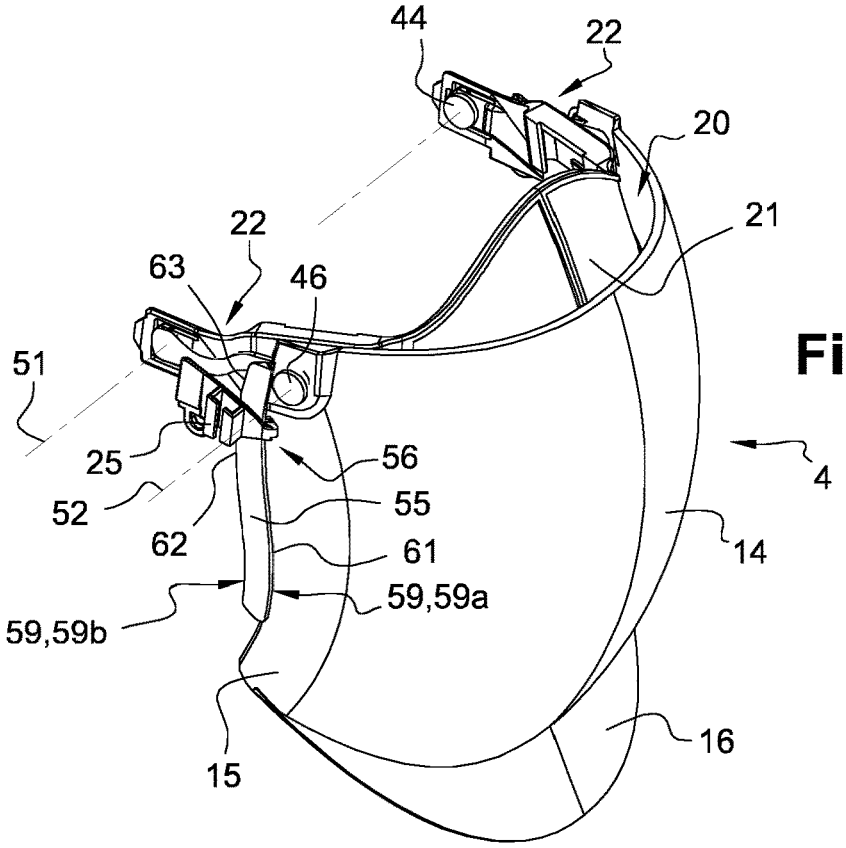
FIG. 14*b* is a perspective view of the helmet of FIG. 1 with the support and shield in a position corresponding to that in FIG. 14*a*.

In a preferred and non-limiting embodiment or aspect, and in the course of a second phase of movement of shield 4 from its raised position to its lowered position, the sliding track 56 of support 20 operates together with the central portion 62 of the guide surface 59 of rail 55, as illustrated in FIGS. 14*a* and 14*b*. Due to the substantially or roughly vertical form of the central portion 62, shield 4 is guided during this second phase to move substantially or roughly vertically and downward.

In a preferred and non-limiting embodiment or aspect, and in the course of a third phase of movement of shield 4 from its raised position to its lowered position (illustrated in FIG. 15), sliding track 56 of support 20 operates together with the upper portion 63 of guide surface 59 of rail 55. The upper portion 63 being curved, with concavity facing forward, shield 4 is guided during this third phase to come close to the face of the user.

In this manner provided is a protective helmet, face shield, and assembly arrangement or device that represents an improvement over existing protective helmets and configurations. Further, and as discussed, and due to the unique and innovative nature of the assembly arrangement or device (e.g., the combined interaction and guidance of the rod and the rail), the position of the shield's center of rotation changes in the space when the shield moves toward its lowered position or toward its raised position. This allows the shield both to move and to be housed when it is in the raised position, in a space of small size, which would not be possible with a simple rotation mechanism.

The present invention is not limited to the embodiments described hereinabove by way of examples, but includes any technical equivalents and variants of the means described, as well as combinations thereof. For example, in some embodiment, the rail is described as being an integral part of the shield; however, the rail could be in the form of a distinct piece and attached onto the shield. Similarly, the sliding track operating together with the rail could be in the form of a distinct piece assembled onto the support or onto the shell.

It is understood that the invention is not limited to the embodiments described above by way of examples but that it comprises all the technical equivalents and the variants of the means described as well as their combinations. Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A protective helmet, comprising: a shell configured to protect a head of a user;

a cap attached in an inside of the shell; and a face shield comprising a central portion and a pair of side wings positioned on lateral sides of the central portion, each of the pair of side wings of the face shield attached to the shell by at least one assembly arrangement, the face shield having a raised position and a lowered position, wherein the face shield is movable between:

the lowered position in which the face shield is adapted to be located substantially in front of a user's face; and the raised position in which the face shield is located in a space between the cap and the inside of the shell;

wherein the at least one assembly arrangement comprises:

a rod having a first end pivotally connected to a portion of the shell about a first substantially transverse axis and a second end pivotally connected to an upper end of one of the pair of side wings of the face shield about a second substantially transverse axis different from the first substantially transverse axis; and a rail installed on the one of the pair of side wings, the rail projecting laterally and toward the exterior of the one of the pair of side wings, the rail projecting from below the upper end of one of the pair of side wings of the face shield, the rail defining at least one guide surface received within a sliding track integral with the shell, the sliding track configured to guide a movement of the face shield from the lowered position to the raised position and back along, but spaced from, the inside of the shell.

2. The helmet of claim 1, further comprising a first assembly arrangement and a second assembly arrangement, wherein the second end of the rod of each of the first and second assembly arrangement is connected to an upper portion of the respective side wing of the face shield.

3. The helmet of claim 1, wherein the at least one guide surface comprises a lower portion having a shape substantially similar to a shape of a front portion of the shell, such that, during a first phase of the movement of the face shield from the raised position to the lowered position, the face shield substantially follows at least a portion of the inside of the shell.

4. The helmet of claim 3, wherein the lower portion of the at least one guide surface is substantially convex toward the front portion of the shell.

5. The helmet of claim 3, wherein the at least one guide surface comprises a portion located above the lower portion and having a substantially rectilinear shape configured to cause, during a second phase following the first phase of movement of the face shield from the raised position to the lowered position, a substantially vertical and downward movement of the face shield.

6. The helmet of claim 3, wherein the at least one guide surface comprises a portion located above the lower portion and having a radius of curvature configured to cause, during a second phase following the first phase of movement of the face shield from the raised position to the lowered position, a substantially vertical and downward movement of the face shield.

7. The helmet of claim 3, wherein the at least one guide surface includes a curved upper portion having a forward-facing concavity configured to cause, during a third phase following the first phase and a second phase of movement of the face shield from the raised position to the lowered position, the face shield to move closer to the user's face.

8. The helmet of claim 3, wherein the at least one guide surface includes a substantially rectilinear upper portion configured to cause, during a third phase following the first phase and a second phase of movement of the face shield from the raised position to the lowered position, the face shield to move closer to the user's face.

9. The helmet of claim 1, wherein the at least one guide surface has a substantially flattened S-shape.

10. The helmet of claim 1, wherein the rail has a substantially L-shaped or substantially T-shaped cross section, and the rail is housed in the sliding track having a cross section that is substantially U-shaped or substantially C-shaped.

11. The helmet of claim 1, wherein the rail projects laterally and toward an outside of one of the side wings of the face shield.

12. The helmet of claim 1, further comprising at least one support mounted in the inside of the shell and comprising at least one housing configured to receive a body configured to connect the cap to the shell.

13. The helmet of claim 12, wherein the at least one housing is adapted to be positioned substantially near a user's temple when the user is wearing the helmet.

14. The helmet of claim 12, wherein the at least one support is connected to the first end of the rod, thereby facilitating pivoting of the rod around the first axis, and wherein the sliding track is configured to operate together with the at least one guide surface of the rail.

15. The helmet of claim 14, wherein the sliding track is positioned on each of the side wings of the face shield.

16. The helmet of claim 12, wherein the at least one support has a substantially semi-circular shape and is fastened to the inside of the shell, wherein the at least one support is substantially horizontally disposed between a headband and the inside of the shell, and wherein a clearance space is located between the at least one support and the inside of the shell and sized to receive the face shield in the raised position.

17. The helmet of claim 1, wherein the face shield comprises at least one orifice having substantially a transverse axis corresponding to the second substantially transverse axis of the rod.

18. The helmet of claim 1, wherein the face shield is configured to extend substantially as far as a user's temples when the user is wearing the helmet.

19. The helmet of claim 1, wherein the face shield comprises a lower rim projecting toward a front side.

* * * * *